US008203420B2

(12) United States Patent
Wiryana et al.

(10) Patent No.: US 8,203,420 B2
(45) Date of Patent: Jun. 19, 2012

(54) SUBMINIATURE FUSE WITH SURFACE MOUNT END CAPS AND IMPROVED CONNECTIVITY

(75) Inventors: Sidharta Wiryana, Kowloon (HK); Essie Rahdar, West Hills, CA (US); Tianyu Zhu, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 349 days.

(21) Appl. No.: 12/492,621

(22) Filed: Jun. 26, 2009

(65) Prior Publication Data

US 2010/0328020 A1 Dec. 30, 2010

(51) Int. Cl.
*H01H 85/157* (2006.01)
*H01H 85/175* (2006.01)
*H01H 85/04* (2006.01)

(52) U.S. Cl. ..... 337/232; 337/248; 337/251; 337/297

(58) Field of Classification Search ..... 337/232, 337/248, 251, 297
See application file for complete search history.

(56) References Cited

U.S. PATENT DOCUMENTS 4,158,187 A * 6/1979 Perreault ..... 337/248
4,208,645 A * 6/1980 Harmon et al. ..... 337/297
4,511,875 A * 4/1985 Arikawa ..... 337/201
4,608,548 A * 8/1986 Borzoni ..... 337/201
4,612,529 A * 9/1986 Gurevich et al. ..... 337/255
4,894,633 A * 1/1990 Holtfreter ..... 337/278
4,920,327 A * 4/1990 Arikawa et al. ..... 337/231
4,962,363 A * 10/1990 Sexton, Jr. ..... 337/186
4,972,169 A * 11/1990 Kalra ..... 337/163
4,988,969 A * 1/1991 Gurevich ..... 337/260
5,162,773 A * 11/1992 Shiozaki ..... 337/201
5,214,406 A * 5/1993 Reese et al. ..... 337/231
5,642,090 A * 6/1997 Arikawa ..... 337/297
5,695,348 A * 12/1997 Legrady ..... 439/78
5,726,620 A * 3/1998 Arikawa ..... 337/227
5,739,740 A * 4/1998 Stark et al. ..... 337/248
5,994,994 A * 11/1999 Ito et al. ..... 337/248
6,147,585 A * 11/2000 Kalra et al. ..... 337/248
6,798,330 B2 * 9/2004 Arikawa et al. ..... 337/231
6,837,755 B1 * 1/2005 Kitajima et al. ..... 439/830
7,248,141 B2 7/2007 Kobayashi et al.
7,564,337 B2 * 7/2009 Whitney et al. ..... 337/268
2006/0055497 A1 * 3/2006 Harris et al. ..... 337/14
2006/0119465 A1 * 6/2006 Dietsch ..... 337/186
2006/0197647 A1 * 9/2006 Whitney et al. ..... 337/297
2010/0090792 A1 * 4/2010 Whitney et al. ..... 337/251
2010/0194519 A1 * 8/2010 Harris et al. ..... 337/227
2010/0245025 A1 * 9/2010 de Leon et al. ..... 337/290

* cited by examiner

*Primary Examiner* — Anatoly Vortman
(74) *Attorney, Agent, or Firm* — Armstrong Teasdale LLP

(57) ABSTRACT

Subminiature surface mount chip fuses include two part housings enclosing a fuse element and prefabricated end caps. The housing ends are shaped to restrict freedom of movement of the fuse element ends as the end caps are assembled to the housing. The end caps may include features to positively secure them in place and restrict relative movement of the end caps relative to the housing. Holes may be provided in the end caps that allow solder flow from a location exterior to the end caps to flow interior to the end caps to establish electrical connection with the fuse element.

25 Claims, 11 Drawing Sheets

SUBMINIATURE FUSE WITH SURFACE MOUNT END CAPS AND IMPROVED CONNECTIVITY

BACKGROUND OF THE INVENTION

The field of the invention relates generally to electrical fuses, and more specifically to surface mount fuses for circuit board applications.

Fuses are widely used as overcurrent protection devices to prevent costly damage to electrical circuits. Typically, fuse terminals or contacts form a current path and electrical connection between an electrical power source and an electrical component or a combination of components arranged in an electrical circuit. One or more fusible links or elements, or a fuse element assembly, is connected between the fuse terminals or contacts, so that when electrical current through the fuse exceeds a predetermined threshold, the fusible elements melt, disintegrate, sever, or otherwise open the current path through the fuse element, and hence the circuit associated with the fuse to prevent electrical component damage.

A proliferation of electronic devices in recent times has resulted in increased demands on fusing technology. Particularly for miniaturized fuses designed to be surface mounted to circuit boards, manufacturing improvements and performance improvements are especially desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
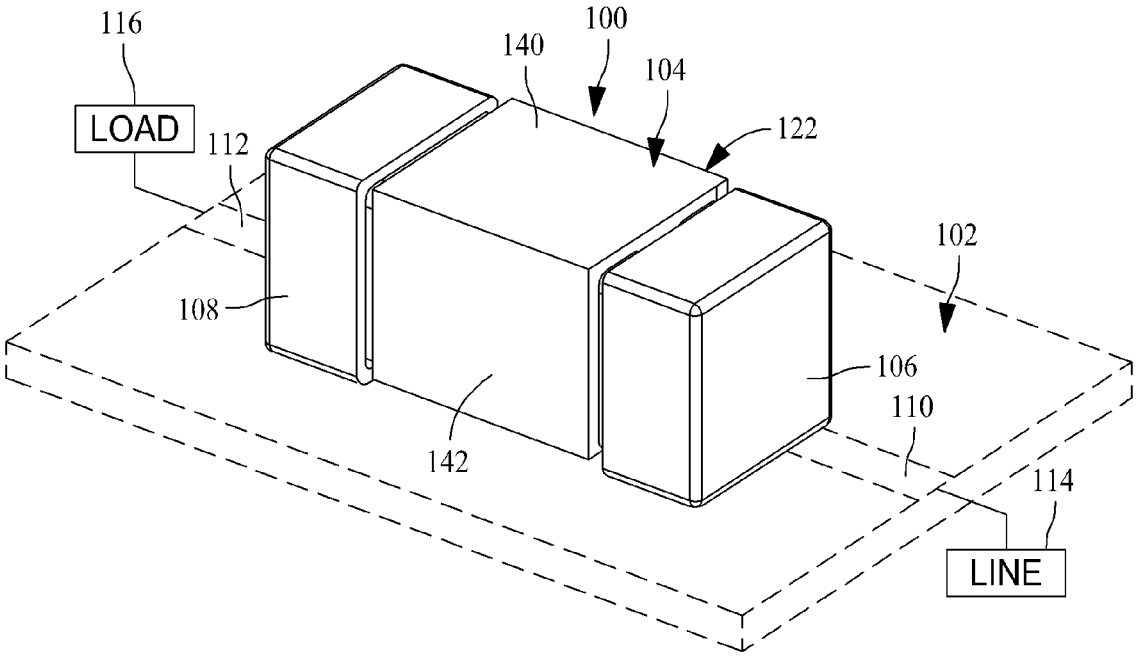
FIG. 1 is a perspective view of a first exemplary embodiment of a surface mount fuse in accordance with an aspect of the present invention.

Exemplary embodiments of surface mount fuse constructions for circuit board applications and electronic devices are described hereinbelow that overcome numerous problems in the art. In order to understand the invention to its fullest extent, the following disclosure is presented in different Parts or segments, wherein Part I introduces the art and problems associated therewith, and Part II discloses advantageous embodiments of fuse constructions and methods overcoming the issues discussed in Part I.

Part I: Introduction

Conventionally, fuses for electronic applications included a wire fuse element (or alternatively a stamped and/or shaped metal fuse element) encased in a glass cylinder or tube and suspended in air within the tube. The fuse element is extended between conductive end caps attached to the tube for connection to an electrical circuit. However, when used with printed circuit boards in electronic applications, the fuses typically must be quite small, and tend to require leads which may be soldered to a circuit board having through-holes therein for receiving the leads. Miniature electronic fuses of this type are known and can be effective in protecting electronic circuitry. However, such fuses can be fragile, and through-hole mounting of such fuses can be tedious and difficult to install to circuit boards, especially as the physical size of the fuse is decreased.

At least in part to avoid manufacturing and installation difficulties of through-hole mounted miniature electronic fuses, so-called chip fuses have been developed which may be surface mounted to circuit boards. Chip fuses may be manufactured in layers, eliminating a need for separately provided, fragile fuse tubes and the lead assemblies of the devices described above, while at the same time providing better fusing characteristics (e.g., faster acting fuses) for some electronic circuits. Such chip fuses may include, for example, a substrate layer, a fuse element layer, one or more insulative or protective layers overlying the fuse element layer, and end terminations formed over the substrate and the fuse element layer for surface mounting to a circuit board. While such chip fuses provide low cost fuse products that are rather easily surface mounted to circuit boards, they can be relatively expensive to manufacture and are limited in their performance capabilities.

Still more recently, chip-type fuses have been constructed having a prefabricated body and cover that collectively house a fuse element, and prefabricated end caps that are assembled to the body and electrically connected to the fuse element. Typically, the fuse element is soldered to the end caps. The fuse elements and the end caps can be quite small, however, and practical difficulties exist in making the soldered connections.

Of particular concern is incomplete bonding between the fuse element, the solder used, and the conductive end caps. Such bonding issues may result in what is sometimes referred to as "cold soldered" joints that are known to be unreliable, and hence undesirable, in establishing the electrical connection. Cold solder joints may result for different reasons, including, but not limited to a failure to expose the solder to its reflow temperature during soldering processes, and relative movement of the parts being soldered (e.g., the fuse element and the end caps) during soldering processes. Instances of cold soldered joints can be difficult to control or detect when especially small parts are being soldered, such as in modern chip fuse devices. Cold solder joints result in performance variations, and sometimes inoperative fuses, that are unacceptable to electronic device manufacturers.

Recent emphasis on lead-free soldering processes for chip fuses and other electronic components has introduced further challenges to the industry. Known lead-free solders require a higher reflow temperature, typically 30° to 40° C., than conventional soldering materials including lead (e.g., tin/lead solder). As such, because of the higher reflow temperature for preferred soldering materials, undesirable cold soldered joints may be somewhat more likely than before.

Also, exposing ever smaller parts such as those used in known chip fuses to higher soldering temperatures required by lead free solder materials presents still other issues for heat sensitive components of the fuses. Specifically, one or more components of the fuse may distort or become permanently damaged in higher temperature soldering processes, particular when the desired reflow temperature is exceeded, which can sometimes be difficult to control. Plastic materials, for example, used to fabricate the electrically insulating portions of the fuses are susceptible to degrading or melting at higher soldering temperatures, which can negatively impact fuse performance and reliability.

Part II. Exemplary Surface Mount Fuses and Methods

Embodiments of surface mount fuses are described hereinbelow that avoid, if not eliminate, instances of defective cold solder joints as well as provide manufacturing advantages including but not limited to lower costs and improved reliability and performance characteristics. Manufacturing and installation methods associated with the surface mount fuses described will be in part apparent and in part specifically pointed out in the discussion below. Like reference numerals refer to like parts throughout the various drawings unless otherwise specified FIG. 1-9 illustrate a first exemplary embodiment of a surface mount fuse 100 for surface mount connection to a circuit board 102 (shown in phantom in FIG. 1). As shown in FIG. 1, the fuse 100 includes an electrically insulating or nonconductive body or housing 104, and conductive end caps 106, 108 coupled to opposing ends of the housing 104. The conductive end caps 106, 108 define respective surface mount areas for connection to circuit pads or traces 110, 112 (shown in phantom in FIG. 1) according to known techniques, including but not limited to soldering processes. The pad or trace 110 may be connected to a power supply or line side circuitry 114 associated with the board 110, and the pad or trace 112 may be connected to load side components or circuitry 116 associated with the board 102.

Figure 2:
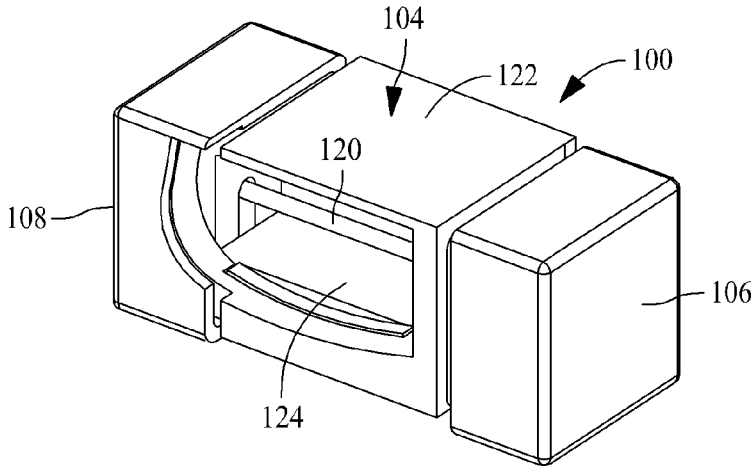
FIG. 2 illustrates the surface mount fuse shown in FIG. 1 partly broken away.

As shown in FIG. 2, wherein the housing 104 of the fuse 100 is partly broken away, a fuse element 120 extends through the housing 104 between the end caps 106 and 108, and the end caps 106 and 108 are electrically connected to the fuse element 120 such that a conductive current path is established through the fuse 100. When the end caps 106 and 108 are, in turn, electrically connected to the circuit traces or pads 110, 112 (FIG. 1), an electrical circuit is completed through the fuse element 120 between the line side circuitry 114 and the load side circuitry 116. The fuse element 124 is constructed to melt, disintegrate, sever, or otherwise open the current path through the fuse element 120 established between the line side circuitry 114 and the load side circuitry 114 (FIG. 1) when electrical current through the fuse exceeds a predetermined threshold. The load side circuitry 116 may therefore be electrically isolated from the line side circuitry 114 and potentially damaging current conditions when they occur. Sensitive and costly components in the load side circuitry 116 may therefore be protected by the fuse 100.

As also seen in FIG. 2, the housing 104 includes a first piece, sometimes referred to as a base 122, and a second piece, sometimes referred to as a cover 124. The base 122 and cover 124 may be assembled as explained below, and collectively surround and protect the fuse element 120 for reliable operation thereof.

Figure 3:
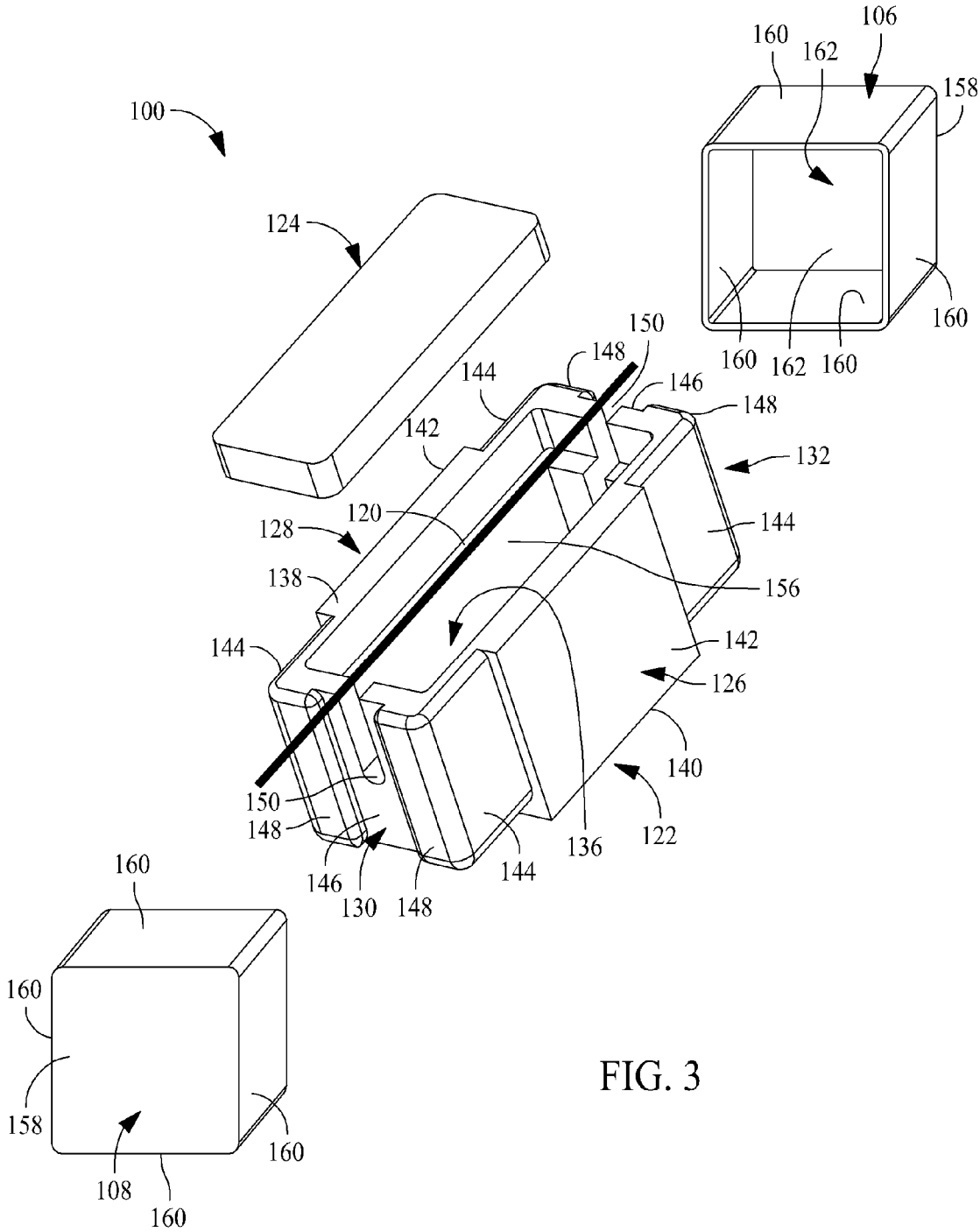
FIG. 3 is an exploded view of the fuse shown in FIGS. 1 and 2.

FIG. 3 illustrates the components of the fuse 100 in exploded view. The housing base 122 is fabricated from an electrically insulating or nonconductive material and includes opposed longitudinal side walls 126, 128 and opposing end walls 130, 132 interconnecting the longitudinal side walls 126, 128. In one embodiment the housing base 122 is fabricated from a ceramic material having sufficient temperature resistance to capably withstand high temperature soldering operations, although other nonconductive materials may likewise be utilized in other embodiments if desired.

The housing base 122 defines a longitudinal axis 134 (FIG. 4) and the longitudinal side walls 126, 128 extend generally parallel to one another and to the longitudinal axis 134. The end walls 130 and 132 extend generally perpendicular to the longitudinal axis 134 and the longitudinal side walls 126, 128. As such, the housing base 122 is generally rectangular and box-like, and a fuse element cavity 136 is defined interior to the side walls 126 and 128 and the end walls 130 and 132. The fuse element cavity 136 is generally open on one side 138 of the base 122 (the upper side as shown in FIGS. 3 and 4) for assembly of the fuse element 120 as explained below, and is closed on the opposing side 140 of the base 122 (i.e., the lower side as shown in FIGS. 3 and 4).

Figure 4:
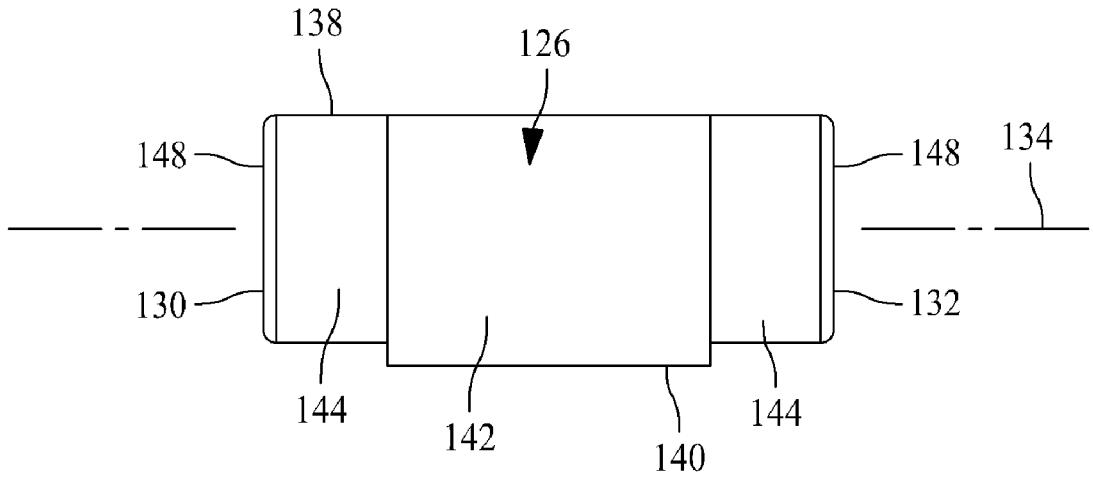
FIG. 4 is a side elevational view of a portion of the fuse assembly shown in FIGS. 2 and 3.
Figure 6:
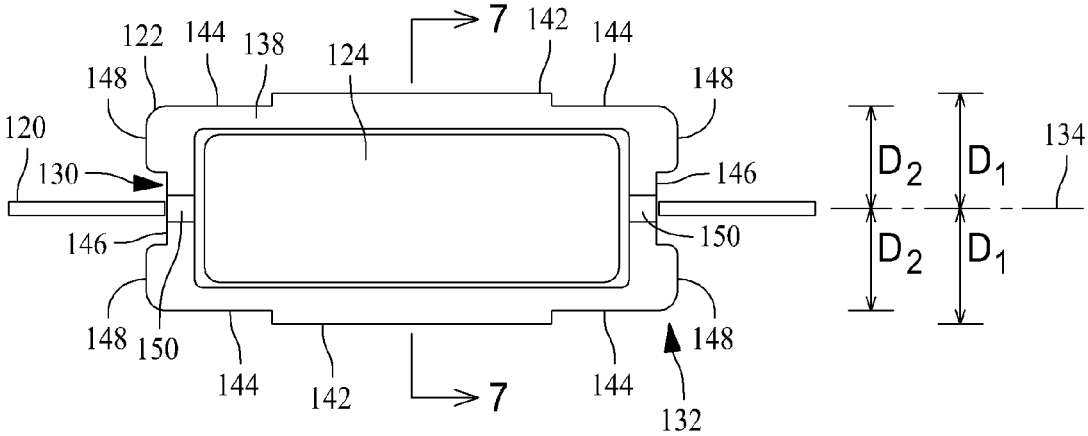
FIG. 6 is a bottom plan view of the fuse assembly shown in FIG. 5.

As shown in FIGS. 3, 4 and 6, the longitudinal side walls 126 and 128 include a stepped outer or exterior surface having a center surface 142 and end surfaces 144 extending on either side of the center surface 142 and opposing one another. The center surface 142 and the end surfaces 144 are generally flat and planar in the illustrated embodiment. The end surfaces 144 are depressed or recessed relative to the center surface 142, such that the end surfaces 144 provide thinner end portions of the side walls 126, 128 leading to the end walls 130, 132. As best seen in FIG. 6, in the exemplary embodiment illustrated the center surfaces 142 of each of the side walls 126, 128 extends in a plane spaced from but parallel to the longitudinal axis 134 at a first distance $D_1$, and the end surfaces 144 of each of the side walls 126, 128 extends in another plane spaced from but parallel to the longitudinal axis 134 at a second distance $D_2$ that is less than the first distance $D_1$. The difference between these dimensions $D_1$ and $D_2$ is approximately equal to a thickness of the end caps 106 and 108 such that when the end caps 106, 108 are installed over the respective end walls 130, 132 the end caps are approximately flush with the exterior surfaces of the housing base 122 that are not covered by the end caps 106, 108 as best shown in FIG. 1.

Figure 5:
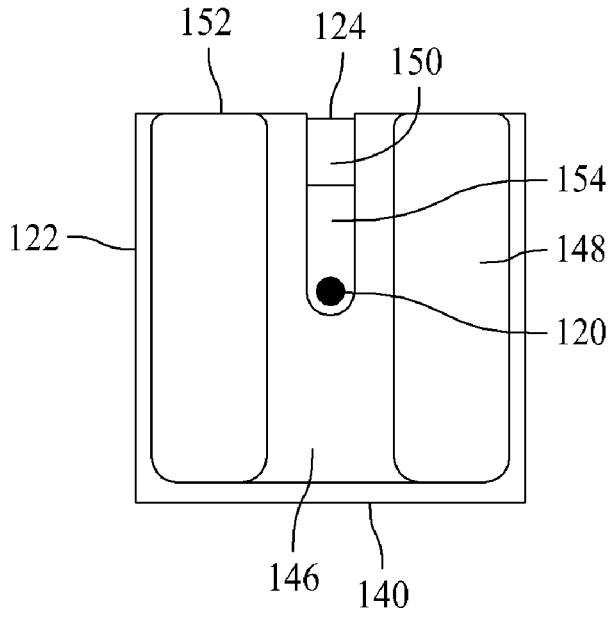
FIG. 5 is an end view of the portion of the fuse assembly shown in FIG. 4.

As shown in FIGS. 2-6, the end walls 130, 132 each include a stepped outer surface including a center surface 146 and end surface 148 extending on either side of the center surface 146 and opposing one another. The center surface 146 in each end wall 130, 132 is depressed or recessed relative to the end surfaces 148 as best seen in FIG. 6, while the end surfaces 148 outwardly project from the center surface 146. An elongated fuse receiving slot 150 is formed in each end wall 130, 132, and as best shown in FIG. 5 extends from a first edge 152 of the end wall toward an approximate midpoint of the center wall. The slot 150 is also approximately centered between the projecting end surfaces 148, and is aligned with the end surfaces 148 such that the end surfaces 148 and the slot 150 extend generally parallel to one another in an axial direction (e.g., a vertical direction in the plane of FIG. 5.)

The fuse element 120, as shown in FIGS. 3, 5, and 6 is received in the slots 150 in each end wall. As shown in FIG. 3, the fuse element 120 may be loaded in the fuse element cavity 136 of the housing base 122 via the slots 150, and as shown in FIG. 5, a bonding agent 154 may be provided to secure the fuse element 120 in position toward the midpoint of each end wall 130, 132. In various embodiments, the bonding agent may be an epoxy based material, a non-epoxy based material, a UV curable glue or other adhesive familiar to those in the art. In other embodiments the bonding agent may be considered optional. When used, the bonding agent 154 secures and maintains the fuse element 120 in a desired position relative to the housing base 122, thereby ensuring a greater reliability in the electrical connections and performance of the fuse element 120.

As illustrated in FIG. 3, the fuse element 120 is a generally straight wire fuse element extending across the housing base 122 between the end walls 130 and 132. The fuse element 120 may be fabricated from a conductive material known in the art, including but not limited to silver, copper, nickel, tin, zinc and alloys thereof, or still other materials if desired. The current capacity of the fuse element is determined by the conductive material utilized and diameter of the wire. Ideally, the fuse element has a high electrical resistance such that relatively small currents actually flow through the fuse element in use. Metcalf techniques and the like may be utilized to vary the fusible action of the element and achieve different performance objectives.

While one particular type of fuse element 120 is shown, it is understood that other types of fuse elements may likewise be used, including but not limited to stamped metal elements having one or more areas of reduced cross section. Additionally, wire fuse elements having other configurations than that shown in FIG. 3 may likewise be utilized. For example, a wire fuse element that is helically wound about a core element may be utilized instead of the substantially straight wire shown in FIG. 3. Still other fuse element types and configurations are possible, and more than one fuse element may be utilized in combination in further and/or alternative embodiments.

The housing cover 124 is, for example, a generally planar cover having a uniform thickness throughout, and is generally rectangular in shape as shown in FIG. 3. The cover 124 is fitted into a complementary-shaped opening 156 in the base 122. As seen in FIGS. 2, 5, 6 and 7, the cover 124 substantially closes the fuse element cavity 136 of the housing base 122. As seen in FIG. 6, however, the ends of the cover 124 are longitudinally spaced from the fuse element receiving slots 150 in the housing base end walls 130, 132. That is, the cover 124 does not extend over the fuse element receiving slots 150, and the fuse element receiving slots are accessible after the cover 124 is installed.

The cover 124, like the housing base 122, may be fabricated from an electrically insulating or nonconductive material. In one embodiment the cover 124 is fabricated from a ceramic material having sufficient temperature resistance to capably withstand high temperature soldering operations, although other nonconductive materials may likewise be utilized in other embodiments if desired. The cover 124 need not be fabricated from the same material as the base in all contemplated embodiments. That is, the housing base 122 and cover 124 may be fabricated from different non-conductive materials having different properties. The cover 124 may be mechanically fitted with the housing base 122 with a slight interference fit, via frictional engagement, via other mechanical engagement techniques, or with bonding agents or adhesives in various exemplary embodiments.

Referring again to the exemplary embodiment shown in FIGS. 3 and 9, the end caps 106 and 108 are each independently fabricated from the remainder of the assembly and are provided as separate component parts for later assembly. The end caps 106, 108 are sometimes referred to as prefabricated parts, and are distinguishable from termination structure formed on the surfaces of the housing itself using metallization techniques, dipping techniques and the like. The end caps 106 are formed according to known methods, and each generally include end walls 158 and four generally orthogonal side walls 160 extending from the end walls 158 and defining a generally rectangular receptacle 162 that may be fitted over and assembled with the respective end walls 130, 132 of the housing base 122. An interior surface of the end wall 158 in each end cap 106, 108 may be provided with an electrical connection media 164 such as solder or conductive ink that may be reflowed and solidified to establish an electrical connection with the fuse element 120. In some embodiments, the electrical connection media 164 may be considered optional and may be omitted.

Figure 7:
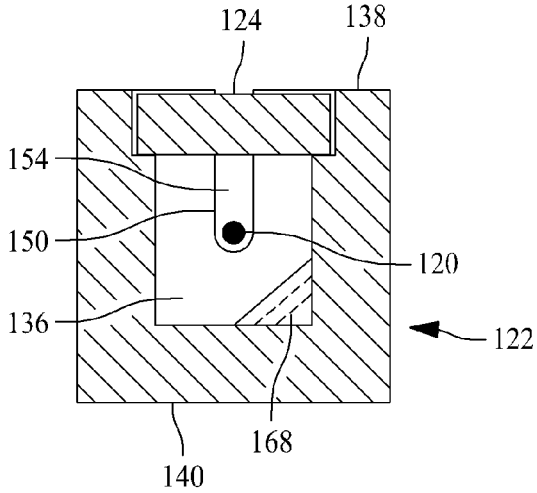
FIG. 7 is a cross sectional view of the assembly shown in FIG. 6 taken along line 7-7.

As partly shown in FIG. 7, the fuse element cavity 136 in the housing base 122 may further be filled with an arc quenching media 166 in some embodiments. In various embodiments, the arc quenching media 166 may be sand or silica materials familiar to those in the art, or glass materials and the like having arc quenching properties to extinguish electrical arcs when the fuse element operates. In other embodiments, the arc quenching media 166 may be considered optional and may be omitted and the fuse element 120 may be surrounded by air inside the housing base 122.

Figure 8:
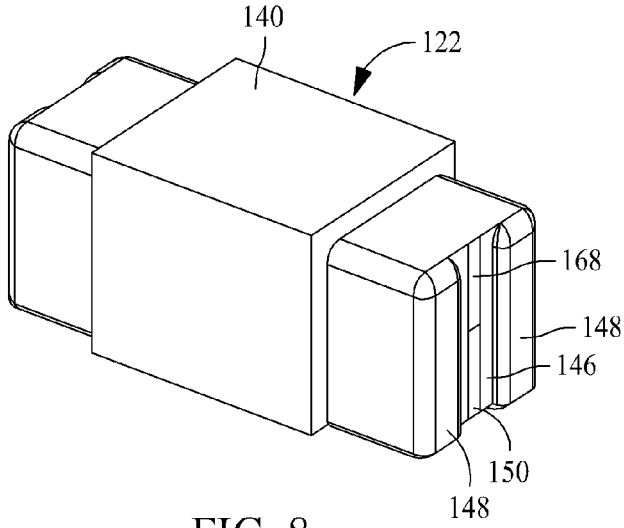
FIG. 8 is a perspective view of the fuse assembly shown in FIGS. 4-7.
Figure 9:
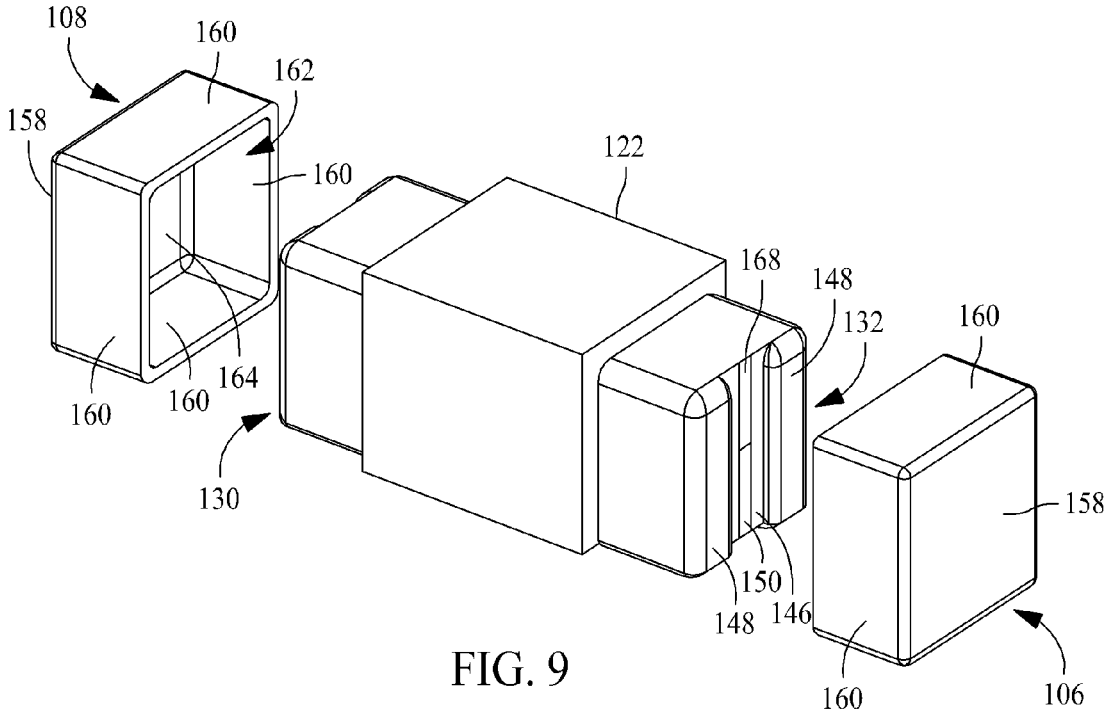
FIG. 9 is a partial exploded view of the fuse shown in FIG. 1.

As shown in FIGS. 8 and 9, the free ends 168 of the fuse element 120 extending exterior to the fuse element cavity 136 of the hosing base 122 are bent at approximately right angles (about 90°) in the example shown, such the fuse element ends 168 extend generally parallel to the end surfaces 148 of the end walls and generally parallel to the center surface 146 of the end walls. Also, the bent ends 168 of the fuse element 120 are generally axially aligned with the fuse element receiving slots 150 in the end walls. The fuse element ends 168 are generally protected by the projecting end surfaces 148 extending alongside the fuse element as the end caps 106, 108 are assembled to the housing base 122. Inadvertent damage to the fuse element ends 168, which can present reliability issues for the completed fuse, is therefore substantially avoided as the end caps 106, 108 are fitted to the housing base 122.

The assembly may also more capably withstand higher soldering temperatures when lead free soldering materials are provided as the connection media 164 (FIG. 9) in the end caps 106, 108.

Also, the projecting end surfaces 148 generally limit movement of the fuse element ends 168 relative to the end caps 106 and 108 as the end caps 106, 108 are assembled/installed over the ends of the housing base 122 and as electrical connections are completed between the fuse element ends 168 and the end caps 106, 108. A confined contact area is consistently established by locating the fuse element ends 168 alongside the depressed center surface 146 in the end walls 130, 132 between the projecting end surfaces 148. Limiting the freedom of movement of the fuse element ends 168, as well as providing a consistent contact area in a predetermined location offers further improvement in the reliability of the electrical connection between the end caps 106, 108 and the fuse element ends 168. As such, cold solder joints and other reliability issues believed to result from movement of the fuse element relative to the end caps 106, 108 as the electrical connections with the fuse element ends 168 are established are substantially avoided.

The assembly is also capable of being implemented on a miniaturized level. Fuses may be provided in miniaturized package sizes for use as chip fuses having a similar scale to other components mounted on a circuit board for an electronic device. Dimensions of such chip fuses are typically measured in millimeters. In one example, completed fuses 100 may be about 6 mm in length measured along the longitudinal axis 134 (FIGS. 4 and 6) and about 3 mm or less in width measured in a direction perpendicular to the longitudinal axis 134 (i.e. a width of the end walls 130, 132 extending between the longitudinal side walls 126, 128 of the housing base 122). Greater or lesser dimensions are possible.

In still another embodiment, when a conductive ink is used in lieu of solder materials, high temperatures associated with soldering techniques, whether lead free solder or otherwise, may be avoided altogether, leading to cost savings in the manufacturing process.

Figure 10:
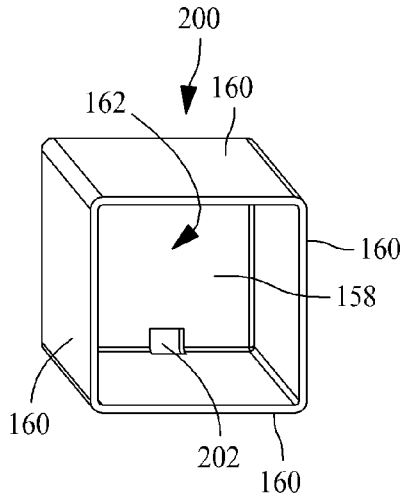
FIG. 10 is a perspective view of a first alternative end cap construction in accordance with an aspect of the present invention.

FIG. 10 is a perspective view of a first alternative end cap structure 200 that may be utilized in lieu of the end caps 106, 108 as described above with even further benefits. Like the end caps 106, 108, the end cap 200 includes an end wall 158 and four generally orthogonal side walls 160 extending from the end wall 158 and defining a generally rectangular receptacle 162 that may be fitted over and assembled with the respective end walls 130, 132 of the housing base 122 as described above. Unlike the end caps 106, 108 shown in FIG. 9, the end cap 200 does not include an electrical connecting media (e.g., solder or conductive ink).

Figure 11:
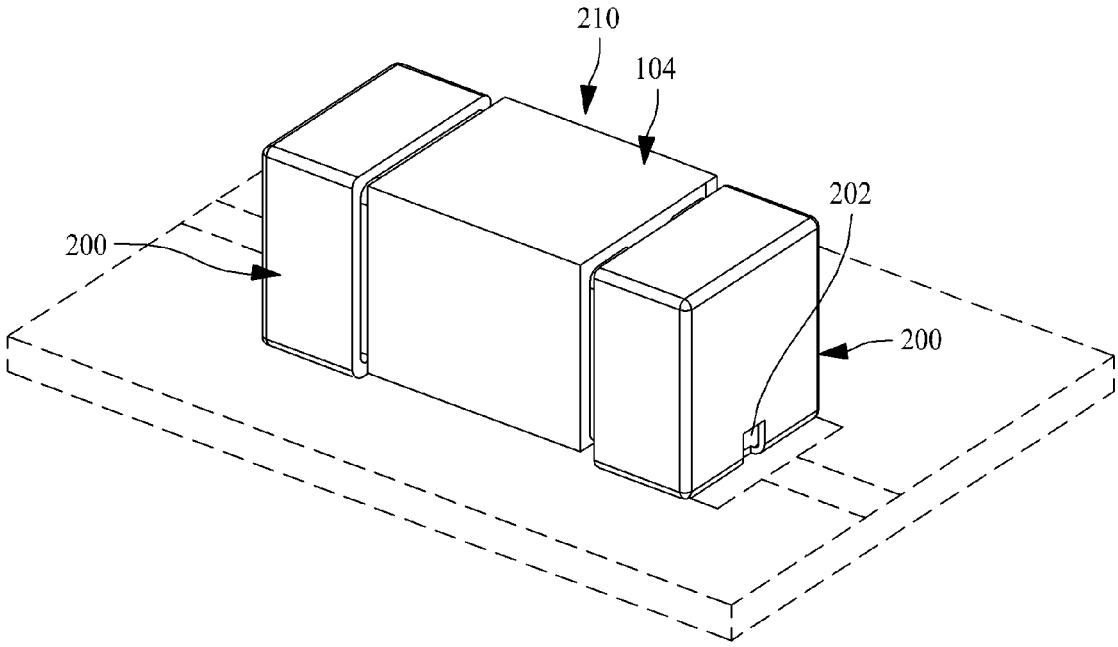
FIG. 11 is a perspective view of a second exemplary embodiment of a surface mount fuse including end caps as shown in FIG. 10.

As shown in FIG. 10, the end cap includes an aperture or hole 202 formed completely through the thickness of the end cap. The hole 202 is formed in a known manner using stamping or punching techniques, for example, and is located adjacent the side wall 160 that is surface mounted to a circuit board, such as the board 102 shown in FIG. 11. End caps 200 may be assembled to the remainder of the assembly described above in a substantially similar manner to that described above to form a completed fuse 210 as shown in FIG. 11. While in the embodiment shown, the hole 202 is formed in a generally square or rectangular shape, it may alternatively be elliptical, rounded, or otherwise shaped in various alternative embodiments.

The hole 202 in the end caps 200 is advantageous because it eliminates any need for a connection media such as solder or conductive ink to be provided in the end caps 200 to make an effective electrical connection with the ends 168 of the fuse element 120. Rather, the electrical connection between the fuse element ends 168 and the end caps 200 is established when the fuse 210 is soldered to the circuit board 102. A portion of the solder used to connect the end caps 200 to the board 102, initially provided external to the fuse 210, will wick inside the holes 202 that are positioned proximate the board 102 and will directly make contact with the fuse element ends 168 interior to the end caps 200. The depressed center surface 146 in the housing end walls 130, 132 (FIG. 9) defines a channel for the solder to flow within the interior of the end cap and it can be practically ensured that the solder will contact the fuse element ends 168.

This direct path connection and simultaneous connection of the end caps 200 to the board 102 as well as the fuse elements ends 168, made possible by the holes 202 in the end caps 200, will result in a lower electrical resistance compared to a fuse including the end caps 106, 108 including internal solder connections without the holes 202 being present. Electrical current need not flow through the end cap 200 itself, but because of the hole 202 allowing the external solder to flow interior to the end caps 200 as the fuse 210 is installed, current may flow through the solder only from a location exterior to the end caps 200 to locations interior to the end caps 200 where the fuse elements ends 168 reside. Material costs associated with solder materials in the construction of the fuse 210 and also labor costs of making separate solder connections internal to the fuse 210, prior to mounting of the fuse 210 on the board 102, are therefore avoided.

Figure 12:
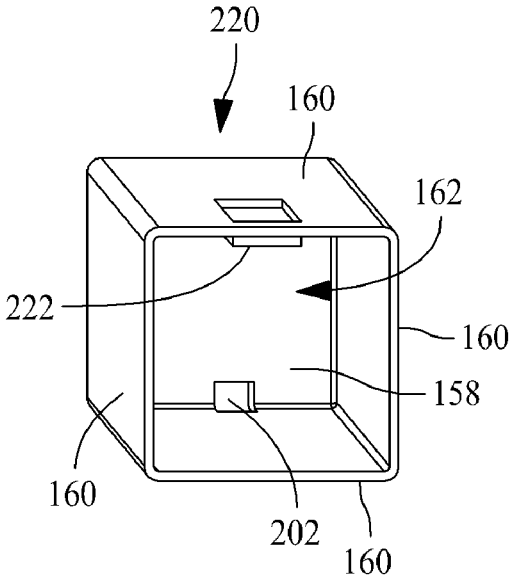
FIG. 12 is a perspective view of a second alternative end cap construction in accordance with an aspect of the present invention.

FIG. 12 is a perspective view of a second alternative end cap structure 220 that may be utilized in lieu of the end caps 200 as described above with still other benefits. Like the end caps 200, the end cap 220 includes an end wall 158 and four generally orthogonal side walls 160 extending from the end wall 158 and defining a generally rectangular receptacle 162 that may be fitted over and assembled with the respective end walls 130, 132 of the housing base 122 as described above. The end cap 200 includes the hole 202 providing the advantages described above, and in one of the walls 160 opposing the hole 202, a retention dimple 222 is also provided in the end cap 200. The dimple 222 may be formed, for example, via a stamping process or other known technique such that an indentation is provided in the exterior surface of the end cap 220, and a projection is provided in the interior of the end cap 220 at the location of the dimple 222.

Figure 13:
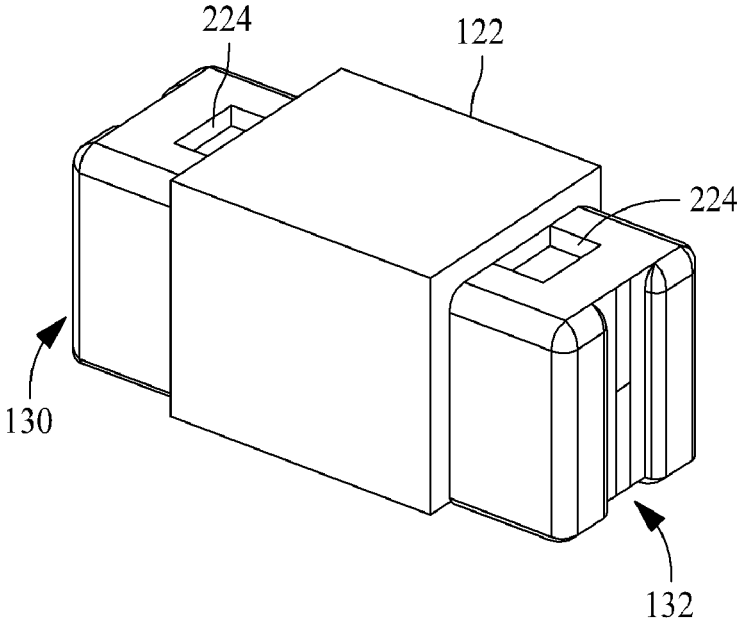
FIG. 13 is a perspective view of a second exemplary embodiment of a fuse sub-assembly for use with the end cap shown in FIG. 12.
Figure 14:
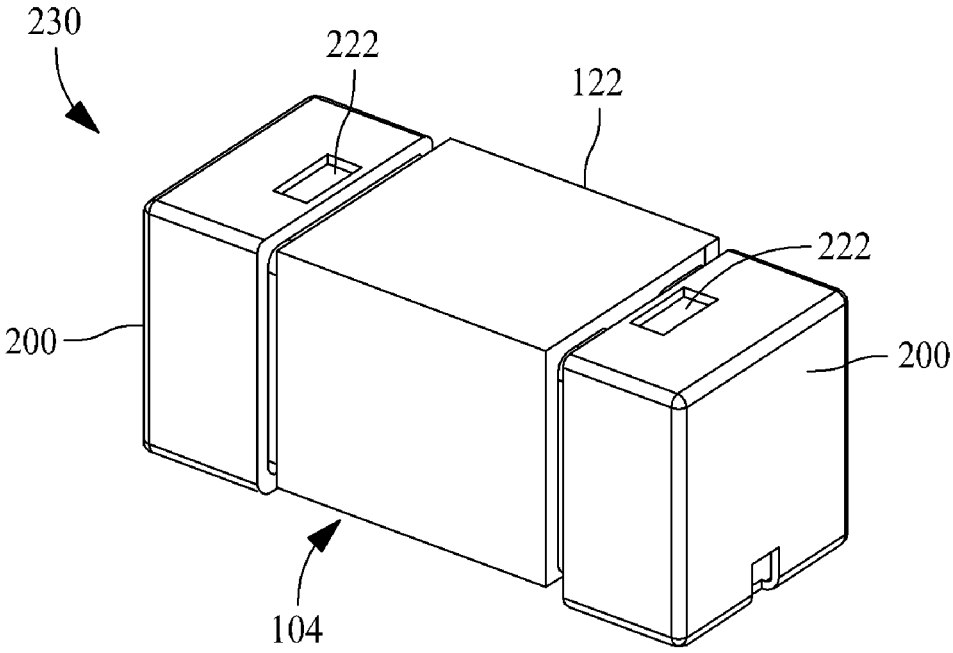
FIG. 14 is a perspective view of a second exemplary embodiment of a fuse including end caps as shown in FIG. 12.

As shown in FIG. 13 the housing base 122 is provided with outward facing retention cavities 224 that are shaped in a complementary manner to the retention dimples 222 in the end caps 220. When the end caps 200 are fitted over the end walls 130, 132 of the housing base 122 to form a completed fuse 230 (FIG. 14), the retention dimples 222 projecting interior to the end caps 220 are interlocked with the retention cavities 224 of the housing base 122, positively securing the end caps 220 to the housing base 122. Relative movement of the end caps 220 relative to the housing base 122 is impeded by the interlocking housing base 122 and end caps 220. Cold solder joints and other undesirable effects attributable to movement of the end caps 220 as the internal electrical connections are established with the fuse element ends 168 are therefore substantially avoided, if not eliminated.

Figure 15:
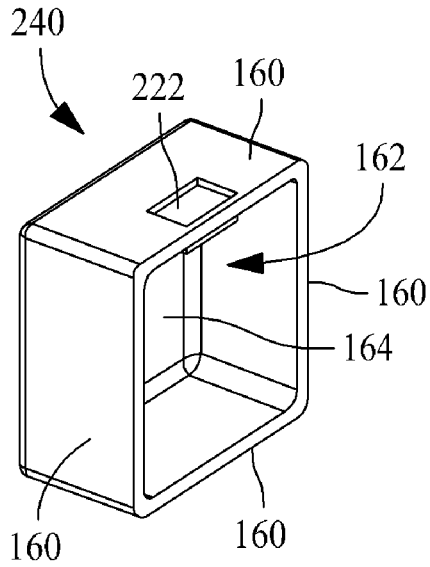
FIG. 15 is a perspective view of a third alternative end cap construction in accordance with an aspect of the present invention.

FIG. 15 is a perspective view of a third alternative end cap structure 240 that may be utilized in lieu of the end caps 220 as described above. Like the end cap 220, the retention dimple 222 is provided, but the hole 202 is not. Because the hole 202 is not provided, the electrical connection media 164 (e.g., solder or conductive ink) is provided in the end cap 240 and the media 164 may be reflowed to establish the electrical connection between the end cap 240 and the fuse element end 168 (FIG. 16).

Figure 16:
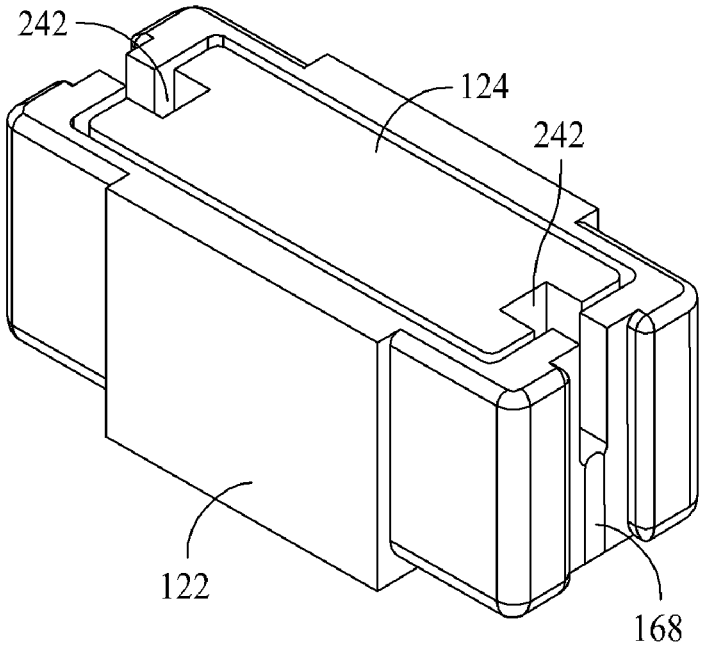
FIG. 16 is a perspective view of a third exemplary embodiment of a fuse sub-assembly for use with the end cap shown in FIG. 15.
Figure 17:
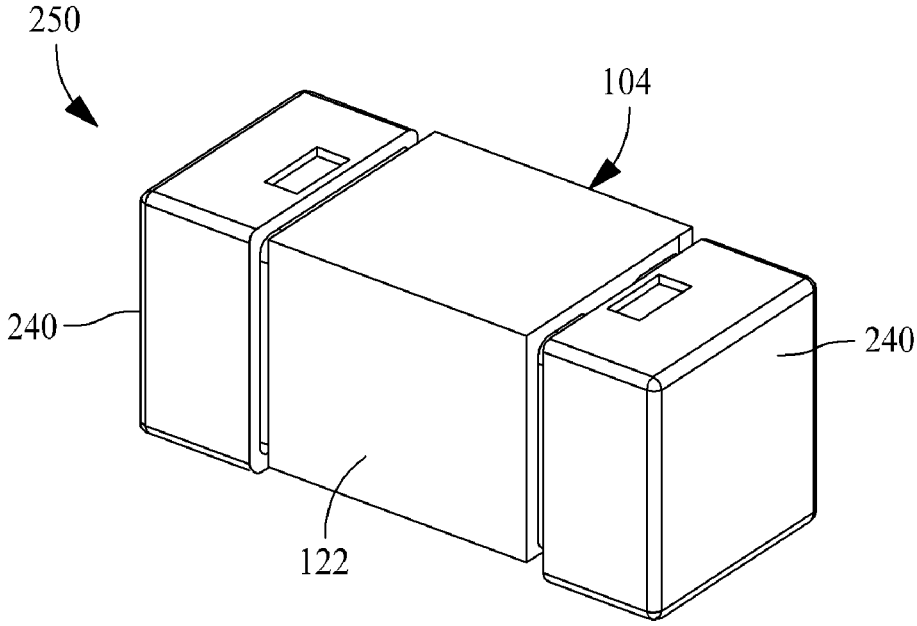
FIG. 17 is a perspective view of a third exemplary embodiment of a fuse including end caps as shown in FIG. 15.

As shown in FIG. 16, the cover 124 is provided with retention openings 242 that are shaped in a complementary manner to the retention dimples 222 in the end caps 240. When the end caps 240 are fitted over the end walls 130, 132 of the housing base 122 to form a completed fuse 250 (FIG. 17), the retention dimples 222 are interlocked with the retention openings 242 and the end caps 240 are positively secured to the housing base 122. Relative movement of the end caps 240 relative to the housing base 122, which can lead to cold solder joints and other undesirable effects, are therefore substantially avoided, if not eliminated.

Figure 18:
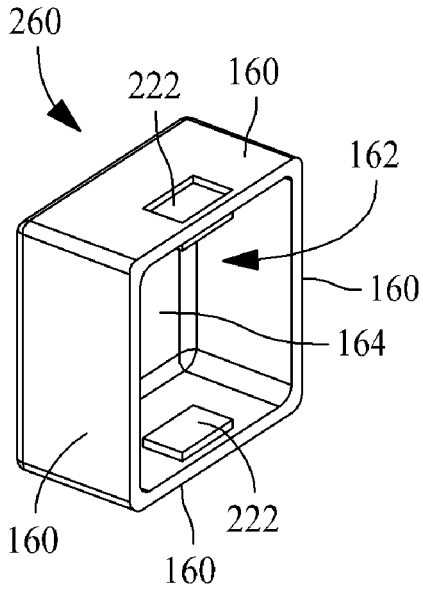
FIG. 18 is a perspective view of a fourth alternative end cap construction in accordance with an aspect of the present invention.

FIG. 18 is a perspective view of a fourth alternative end cap end cap structure 260 that may be utilized in lieu of the end caps 240 as described above. The end cap 260 includes two retention dimples 222 situated on opposing walls 160 of the end cap 260.

Figure 19:
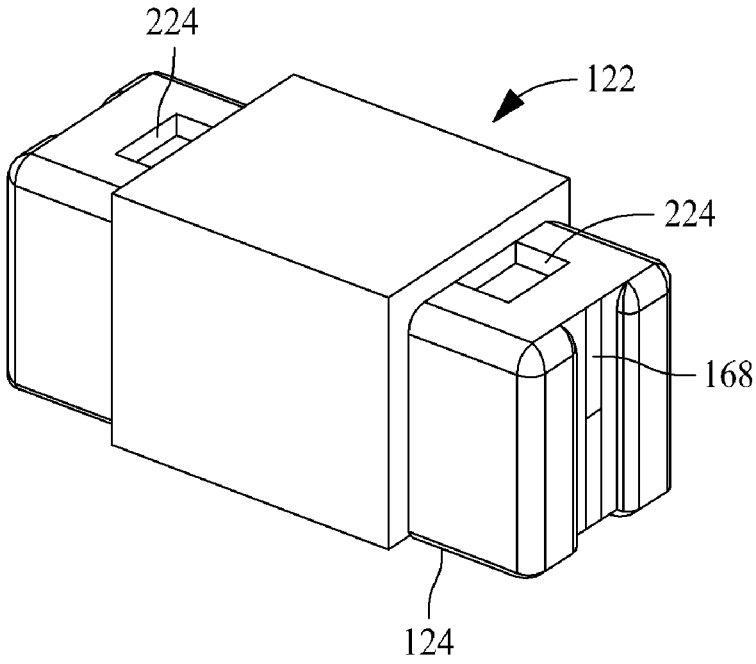
FIG. 19 is a perspective view of a fourth exemplary embodiment of a fuse sub-assembly for use with the end cap shown in FIG. 18.
Figure 20:
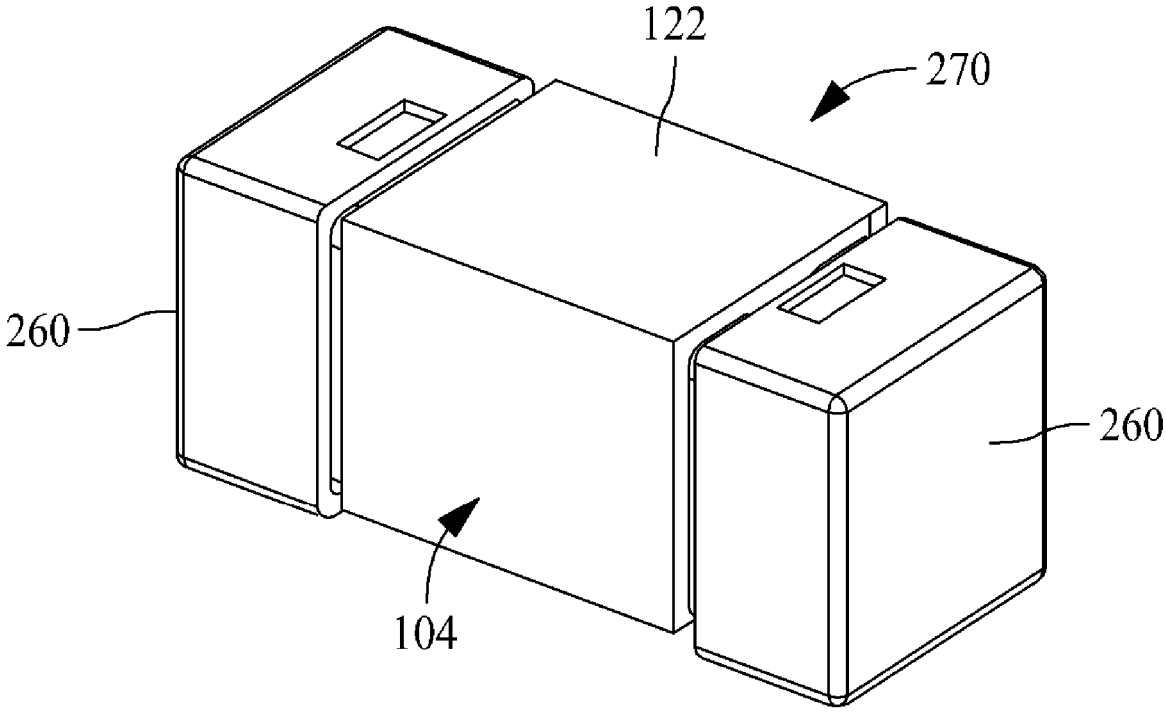
FIG. 20 is a perspective view of a fourth exemplary embodiment of a fuse including end caps as shown in FIG. 18.

As shown in FIG. 19, the housing base 122 is provided with the retention cavities 224 and the cover 124 is provided with retention openings (not visible in FIG. 19 but similar to the openings 242 shown in FIG. 16) that are shaped in a complementary manner to the retention dimples 222 in the end caps 260. When the end caps 260 are fitted over the end walls 130, 132 of the housing base 122 to form a completed fuse 270 (FIG. 20), one of the retention dimples 222 in each end cap 260 is interlocked with one of the retention openings 242 in the housing base 122, and the one of the retention dimples 222 in each end cap 260 is interlocked with the retention openings 242 in the cover 124. As such the end caps 260 are positively secured on more than one side of the fuse housing, resulting in even greater stability of the relative position of the end caps 260 relative to the fuse element ends 168 during assembly, installation, and completion of the electrical connections between the fuse element ends 168 and the end caps 260. Relative movement of the end caps 260 relative to the fuse element ends 168, which can lead to cold solder joints and other undesirable effects and reliability issues, are therefore substantially avoided, if not eliminated.

III. Conclusion

The benefits and advantages of the exemplary embodiments are now believed to be apparent.

An embodiment of an electrical fuse is disclosed that includes a nonconductive housing comprising a base and a separately provided cover fitted to the base. The base comprises opposing longitudinal side walls and opposing end walls interconnecting the longitudinal side walls. The longitudinal side walls extend parallel to a longitudinal axis, the end walls extend perpendicular to the longitudinal axis. The longitudinal side walls and the end walls define an interior fuse element cavity therebetween, and at least one of the end walls comprises a fuse element receiving slot in communication with the interior fuse element cavity.

The cover substantially closes the interior fuse element cavity when the cover is fitted to the base, and the cover is longitudinally separated from the fuse element receiving slot when the cover is fitted to the base. A fuse element is received in the base. The fuse element extends through the fuse element receiving slot and extends across the fuse element cavity between the opposing end walls of the base.

First and second conductive end caps are fitted over the respective opposing end walls of the base adjacent respective ends of the fuse element, the first and second end caps defining a surface mount area for connection to a circuit board.

Optionally, the fuse element includes a bend at a location adjacent to the fuse element receiving slot, whereby a portion of the fuse element end extending exterior to the fuse element receiving cavity extends generally parallel to the end wall. The end wall may include a generally planar surface, and the fuse element receiving slot may be elongated in the plane of the planar surface. The portion of the fuse element extending exterior to the fuse element receiving cavity may be axially aligned with the elongated fuse element receiving slot.

The longitudinal side walls may optionally include a stepped outer surface. The stepped outer surface may include opposing end surfaces and a center surface between the end surfaces, with the end surfaces being depressed relative to the center surface.

The at least one end wall may optionally include a stepped outer surface. The stepped surface may include opposing end surfaces and a center surface between the end surfaces, with the center surface being depressed relative to the end surfaces. The fuse element receiving slot may be formed through the center surface and may be substantially equally spaced from the end surfaces.

The fuse element may optionally extend straight across the fuse element cavity between the opposing end walls.

At least one of the first and second end caps may optionally be provided with solder to establish electrical connection between the at least one end cap and one of the fuse element ends. Alternatively neither of the first and second end caps may be soldered to the fuse element. In one embodiment, one of the first and second end caps may be provided with conductive ink to establish electrical connection between the at least one end cap and one of the fuse element ends.

At least one of the end caps may optionally include at least one retention dimple for securing the end cap to the base. The base may be formed with an exterior end cap receiving cavity adjacent at least one of the end walls, and the retention dimple may be interlocked with the receiving cavity when the at least one end cap is fitted to the base. The cover may be formed with an end cap receiving opening, the end cap receiving opening located adjacent at least one of the end walls when the cover is fitted to the base, and the retention dimple being interlocked with the receiving opening when the at least one end cap is fitted to the cover. The at least one end cap may include an end wall, a first side wall and a second side wall, and the at least one retention dimple may include a first retention dimple formed in the first side wall and a second retention dimple formed in the second side wall. The retention dimple may optionally be substantially rectangular in shape.

At least one of the end caps may optionally include an aperture extending completely through a thickness of the end cap, with the aperture located proximate the surface mount area. The end cap may further include a retention dimple for positively securing the end cap to one of the base and the cover.

At least one of the base and the cover may optionally be fabricated from a ceramic material. The fuse element receiving cavity may optionally be filled with an arc quenching media. The fuse element may optionally be bonded to the fuse element receiving slot. The cover may be a generally planar cover having a uniform thickness.

An embodiment of an electrical fuse is also disclosed including a nonconductive housing comprising a base and a cover. The base comprises opposing longitudinal side walls and opposing end walls interconnecting the longitudinal side walls, with the lateral side walls and the end walls defining a fuse element cavity therebetween. The cover is fitted to the base and substantially closes the fuse element cavity. A fuse element received in the fuse element receiving slot and extends across the fuse element cavity between the end walls of the base. First and second terminal elements include conductive end caps fitted over the respective end walls of the base proximate a respective end of the fuse element. The first and second end caps each define a surface mount area for connection to a circuit board. One of the end caps comprises at least one of a retention dimple and an opening formed completely through a thickness of the end cap proximate the surface mount area.

Optionally, the base may include an exterior end cap retention cavity that receives the retention dimple. The cover may optionally include an end cap retention opening that receives the retention dimple. At least one of the end walls may include a fuse element receiving slot. The cover may be longitudinally spaced from the fuse element receiving slot when the cover is fitted to the base.

One of the end caps may optionally be provided with solder to establish electrical connection between the one end cap and one of the ends of the fuse element. Alternatively, neither of the end caps is internally provided with solder to establish the electrical connection between the one end cap and one of the ends of the fuse element. One of the end caps may be provided with conductive ink to establish the electrical connection between the one end cap and one of the ends of the fuse element.

At least one of the base and the cover may be fabricated from a ceramic material. The fuse element receiving cavity may be filled with an arc quenching media. The fuse element may be bonded to the fuse element receiving slot. The cover may include a generally planar element of uniform thickness.

An embodiment of an electrical fuse is disclosed including a nonconductive housing comprising a base and a separately provided cover. The base includes opposing longitudinal side walls and opposing end walls interconnecting the longitudinal side walls, with the lateral side walls and the end walls defining an interior fuse element cavity therebetween. The cover is fitted to the base and substantially closing the fuse element cavity. A fuse element is received in the fuse element receiving slot and extends across the fuse element cavity between the end walls of the base. First and second terminal elements comprising conductive end caps fitted over the respective end walls of the base. The first and second end caps define a surface mount area for connection to a circuit board. One of the end caps includes an opening formed completely through a thickness of the end cap proximate the surface mount area, whereby when the end cap is soldered to a circuit board solder may flow through the opening from an exterior of the end cap to the interior of the end cap and establish a direct electrical connection to the fuse element.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical fuse comprising:

a nonconductive housing comprising a base and a separately provided cover fitted to the base;

wherein the base comprises opposing longitudinal side walls and opposing end walls interconnecting the longitudinal side walls, the longitudinal side walls extending parallel to a longitudinal axis, the end walls extending perpendicular to the longitudinal axis, the longitudinal side walls and the end walls defining an interior fuse element cavity therebetween, and at least one of the end walls comprising a fuse element receiving slot in communication with the interior fuse element cavity; and wherein the cover substantially closes the interior fuse element cavity when the cover is fitted to the base, and the cover is longitudinally separated from the fuse element receiving slot when the cover is fitted to the base;

a fuse element received in the base, wherein the fuse element extends through the fuse element receiving slot and extends across the fuse element cavity between the opposing end walls of the base; and first and second conductive end caps fitted over the respective opposing end walls of the base adjacent respective ends of the fuse element, the first and second end caps defining a surface mount area for connection to a circuit board.

2. The electrical fuse of claim 1, wherein the fuse element includes a bend at a location adjacent to the fuse element receiving slot, whereby a portion of the fuse element end extending exterior to the fuse element receiving cavity extends generally parallel to the end wall.

3. The electrical fuse of claim 2, wherein the end wall includes a generally planar surface, and the fuse element receiving slot is elongated in the plane of the planar surface, and the portion of the fuse element extending exterior to the fuse element receiving cavity is axially aligned with the elongated fuse element receiving slot.

4. The electrical fuse of claim 1, wherein the longitudinal side walls include a stepped outer surface.

5. The electrical fuse of claim 4, wherein the stepped outer surface comprises opposing end surfaces and a center surface between the end surfaces, the end surfaces being depressed relative to the center surface.

6. The electrical fuse of claim 1, wherein the at least one end wall includes a stepped outer surface.

7. The electrical fuse of claim 6, wherein the stepped surface comprises opposing end surfaces and a center surface between the end surfaces, the center surface being depressed relative to the end surfaces.

8. The electrical fuse of claim 7, wherein the fuse element receiving slot is formed through the center surface and is substantially equally spaced from the end surfaces.

9. The electrical fuse of claim 1, wherein the fuse element extends straight across the fuse element cavity between the opposing end walls.

10. The electrical fuse of claim 1, wherein at least one of the first and second end caps is provided with solder to establish electrical connection between the at least one end cap and one of the fuse element ends.

11. The electrical fuse of claim 1, wherein neither of the first and second end caps are soldered to the fuse element.

12. The electrical fuse of claim 1, wherein one of the first and second end caps is provided with conductive ink to establish electrical connection between the at least one end cap and one of the fuse element ends.

13. The electrical fuse of claim 1, wherein at least one of the end caps comprises at least one retention dimple for securing the end cap to the base.

14. The electrical fuse of claim 13, wherein the base is formed with an exterior end cap receiving cavity adjacent at least one of the end walls, the retention dimple being interlocked with the receiving cavity when the at least one end cap is fitted to the base.

15. The electrical fuse of claim 13, wherein the cover is formed with an end cap receiving opening, the end cap receiving opening located adjacent at least one of the end walls when the cover is fitted to the base, the retention dimple being interlocked with the receiving opening when the at least one end cap is fitted to the cover.

16. The electrical fuse of claim 13, wherein the at least one end cap comprises an end wall, a first side wall and a second side wall, and wherein the at least one retention dimple comprises a first retention dimple formed in the first side wall and a second retention dimple formed in the second side wall.

17. The electrical fuse of claim 13, wherein the retention dimple is substantially rectangular in shape.

18. The electrical fuse of claim 1, wherein at least one of the end caps comprises an aperture extending completely through a thickness of the end cap, the aperture located proximate the surface mount area.

19. The electrical fuse of claim 18, wherein the end cap further comprises a retention dimple for positively securing the end cap to one of the base and the cover.

20. The electrical fuse of claim 1, wherein at least one of the base and the cover is fabricated from a ceramic material.

21. The electrical fuse of claim 1, wherein the fuse element receiving cavity is filled with an arc quenching media.

22. The electrical fuse of claim 1, wherein the fuse element is bonded to the fuse element receiving slot.

23. The electrical fuse of claim 1, wherein the cover is a generally planar cover having a uniform thickness.

24. An electrical fuse comprising:

a nonconductive housing comprising a base and a separately provided cover, the base comprising opposing longitudinal side walls and opposing end walls interconnecting the longitudinal side walls, the longitudinal side walls and the end walls defining an interior fuse element cavity therebetween, and the base further defining an opening in communication with the fuse element cavity, the cover being substantially planar and having a complementary shape to the opening defined in the base, the cover fitted to the opening defined in the base and substantially closing the fuse element cavity;

a fuse element received in the fuse element cavity; and first and second terminal elements comprising conductive end caps fitted over the respective end walls of the base, the first and second end caps defining a surface mount area for connection to a circuit board;

wherein one of the end caps comprises an opening formed completely through a thickness of the end cap proximate the surface mount area, whereby when the end cap is soldered to a circuit board solder may flow through the opening from an exterior of the end cap to the interior of the end cap and establish a direct electrical connection to the fuse element.

25. An electrical fuse comprising:

a nonconductive housing comprising a base and a cover, the base comprising opposing longitudinal side walls and opposing end walls interconnecting the longitudinal side walls, the longitudinal side walls and the end walls defining a fuse element cavity therebetween, the cover fitted to the base and substantially closing the fuse element cavity;

a fuse element received in the fuse element cavity; and first and second terminal elements comprising conductive end caps fitted over the respective end walls of the base proximate a respective end of the fuse element, the first and second end caps each defining a surface mount area for connection to a circuit board;

wherein one of the end caps comprises at least one of a retention dimple and an opening formed completely through a thickness of the end cap proximate the surface mount area;

wherein at least one of the end walls comprises a fuse element receiving slot; and wherein the cover is longitudinally spaced from the fuse element receiving slot when the cover is fitted to the base.

* * * * *